US006106294A

United States Patent [19]

Daniel

[11] Patent Number: 6,106,294

[45] Date of Patent: Aug. 22, 2000

[54] LIGHTING TOOTHBRUSH AND METHOD OF USE

[76] Inventor: Martin K. Daniel, 2176 Oxford Ave., Claremont, Calif. 91711

[21] Appl. No.: 09/270,466

[22] Filed: Mar. 15, 1999

[51] Int. Cl.[7] ..... A46B 15/00; A61C 17/00

[52] U.S. Cl. ..... 433/216; 15/105; 15/167.1; 362/109; 446/485

[58] Field of Search ..... 15/105, 167.1; 362/109, 119, 120; 433/216; 446/485

[56] References Cited

U.S. PATENT DOCUMENTS

| | | | |
|---|---|---|---|
| 2,484,159 | 10/1949 | Flynn, Jr. | 446/485 X |
| 2,959,892 | 11/1960 | Johnson | 446/485 X |
| 4,253,212 | 3/1981 | Fujita | 15/167.1 |
| 4,588,387 | 5/1986 | Swenson | 446/485 X |
| 4,788,734 | 12/1988 | Bauer | 15/105 |
| 4,866,807 | 9/1989 | Kreit et al. | 15/105 |
| 5,339,479 | 8/1994 | Lyman | 15/105 |
| 5,595,437 | 1/1997 | Rapisarda et al. | 15/105 X |
| 5,673,451 | 10/1997 | Moore et al. | 15/105 |
| 5,704,087 | 1/1998 | Strub | 15/105 |
| 6,029,303 | 2/2000 | Dewan | 15/105 |

FOREIGN PATENT DOCUMENTS

| | | | |
|---|---|---|---|
| 3433250 | 3/1986 | Germany | 15/105 |

*Primary Examiner*—Mark Spisich
*Attorney, Agent, or Firm*—Timothy Thut Tyson; Ted Masters; Freilich, Hornbaker & Rosen

[57] ABSTRACT

A lighting toothbrush (20) includes a body (22) which carries a motion-sensing switch (26), a plurality of light emitting devices (30), a timer (32), and a battery (34). As lighting toothbrush (20) is oscillated, motion switch (26) closes sending a signal to timer (32) which applies a voltage waveform (50) to lights (30). In a preferred embodiment, timer (32) causes lights (30) to be sequentially illuminated thereby producing a "twinkle" effect. Also, in a preferred embodiment, all of the components are permanently encapsulated within transparent body (22).

20 Claims, 3 Drawing Sheets

Fig. 7
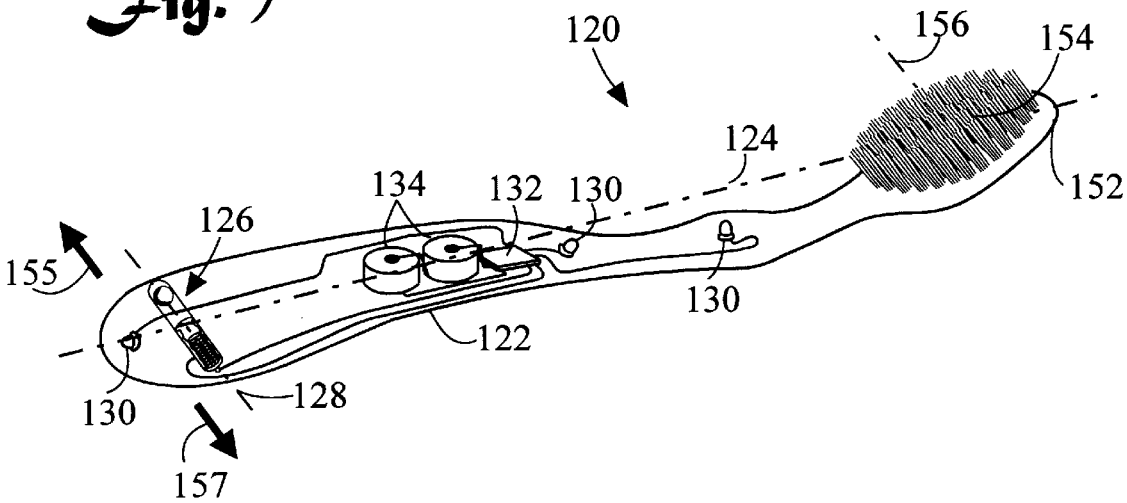
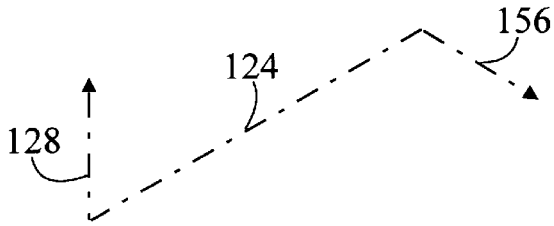
Fig. 8

LIGHTING TOOTHBRUSH AND METHOD OF USE

TECHNICAL FIELD

The present invention pertains generally to toothbrushes, and in particular to a toothbrush having one or more lights which illuminate when the oscillatory motion of the toothbrush reaches a pre-established level.

BACKGROUND ART

Illuminating and noise-producing toothbrushes are well known in the art. For example, U.S. Pat. No. 3,261,978 shows a dental cleaning apparatus which enables persons to better clean their teeth. A light in the toothbrush is used to fluoresce a dye contained in the toothpaste and thereby detect unclean areas. U.S. Pat. No. 4,253,212 illustrates a training appliance for tooth brushing. A sound emitting device and /or light emitting device actuated by brushing movement are provided in the stem of the toothbrush. These devices sense the reciprocating motion and rotational motion of the brush and the pressure being applied on brushing. In one embodiment, a hollow cylindrical body containing a ball or the like is connected to the stem of the brush, so that when the toothbrush is moved back and forth, the ball contacts an electrode which completes a circuit to emit the sound or light. U.S. Pat. No. 4,779,173 defines an illuminated brush device having a head, a handle associate with the head, a light source in the handle, and a source for energizing the light source. The brush device also includes a plurality of plastic filaments each having one end position disposed in the handle and adjacent the light source and the other end position disposed in and through the head so that the light from the light source is transmitted through the plurality of plastic filaments and lights the other end of each filament. U.S. Pat. No. 4,788,734 discloses a toothbrush having signal producing means which produces acoustic signals in the audible range of the human ear. A timer allows the acoustic output to be set, preferably for two minutes per actuation. U.S. Pat. No. 5,030,090 portrays an optical toothbrush and method of use. A plurality of narrow fibers are connected to a light generating device and extend through a brush base, wherein the fibers are bent to form an L-shape and project outwardly from the base to form a brush. Light emitted from the light generating device is guided into each fiber at its base and projected through the brush tips to provide oral hygiene. U.S. Pat. No. 5,133,102 comprises an electronic toothbrush having a handle which accommodates a light-emitting diode and a sound-producing device as well as an electric circuit for actuating the diode and device. When a current is caused to flow through the toothbrush by grasping the brush and bringing it into contact with the teeth, light and sound are emitted to notify the user that the toothbrush is operating. U.S. Pat. No. 5,160,194 consists of a toothbrush with externally illuminated bristles. A hollow tubular handle holds two batteries. A shoulder at the forward end of the handle contains a high output light bulb. Holding the toothbrush automatically compresses a switch to turn on the light bulb. U.S. Pat. No. 5,438,726 describes a tooth cleaning system with timer and signaling means. The signaling apparatus is composed of both an audio and vibrating signaling device to alert the user when the preset time limit is achieved. The invention relates generally to a toothbrush with timer means and more particularly, to a toothbrush capable of alerting a user when sufficient time has elapsed to cease brushing. U.S. Pat. No. 5,572,762 includes a toothbrush with a sound generator and an activating switch device. The toothbrush has a handle portion with a compartment provided adjacent to the proximate end thereof for accommodating the sound generating apparatus and the switch device. The switch device has a push-button which is located at the proximate end of the handle. U.S. Pat. No. 5,813,855 depicts an illuminated toothbrush which is formed of a clear plastic body. Modified plastic filament bristle tufts in its head portion admit light into the bristles from a light source illuminated shaft inserted into a socket in the end of the toothbrush handle.

DISCLOSURE OF INVENTION

The present invention is directed to a lighting toothbrush which lights up for a predetermined period of time when it is oscillated with sufficient speed. In one embodiment back-and-forth horizontal motion causes lights to illuminate, and in another embodiment vertical motion causes the lights to illuminate. A motion switch senses the motion of the lighting toothbrush, and sends a closure signal to a timer which supplies a voltage waveform to a plurality of lights. Depending upon the timer design, the voltage waveform can comprise an unlimited number of lighting combinations. In a preferred embodiment the plurality of lights are sequentially illuminated to produce a "twinkling" effect.

In a preferred embodiment, the lighting toothbrush includes an elongated body having a longitudinal axis. The body includes a handle portion, a neck portion, and an end having bristles located nearby. A motion sensing switch is carried by the body, the motion switch having a motion-sensing axis, the motion-sensing axis being substantially parallel to the longitudinal axis. At least one light emitting device, such as an LED, is carried by the body. A timer, typically comprising an integrated circuit, is carried by the body, with the motion switch and the light emitting device(s) connected to the timer. A power source such as a battery or batteries is carried by the body and connected to the timer. When the body is oscillated substantially along its longitudinal axis, and therefore also substantially along the motion-sensing axis, the motion switch closes actuating the timer which in turn applies a voltage waveform to the light emitting device(s) for a predetermined period of time.

In accordance with an important aspect of the invention, the motion switch, the light emitting devices, the timer, and the power source, are all encapsulated within the body.

In accordance with an important feature of the invention, the body is transparent, so that the aforementioned components are visible to a user.

In accordance with another important aspect of the invention, a plurality of light emitting devices are carried by the body, and the timer applies the voltage waveform to each of the plurality of light emitting devices in time-phased sequence.

In accordance with a preferred embodiment of the invention, the motion switch may either be oriented to sense horizontal or vertical motion.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 7 is a perspective view of a second embodiment; and,

FIG. 8 is a perspective view showing the relationship of the axes in the second embodiment.

MODES FOR CARRYING OUT THE INVENTION

Figure 1:
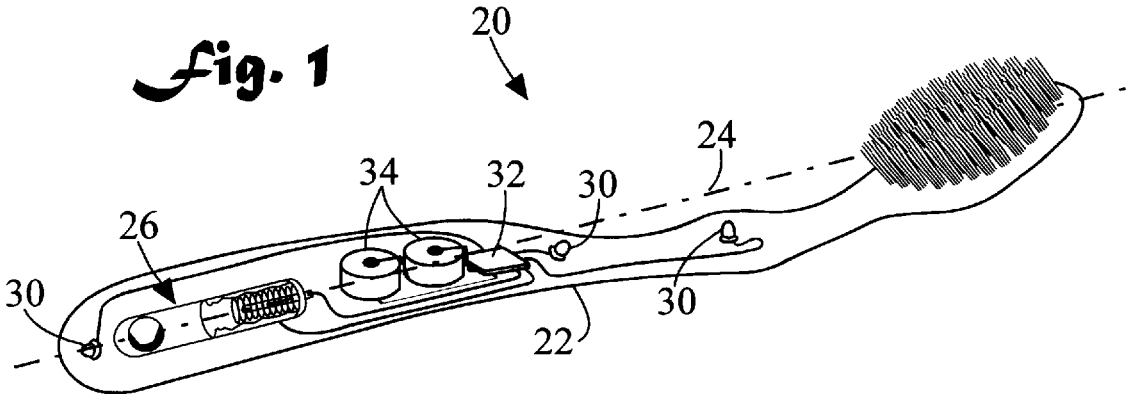
FIG. 1 is a perspective view of a lighting toothbrush in accordance with the present invention.

Referring initially to FIG. 1, there is illustrated a lighting toothbrush in accordance with the present invention, generally designated as 20. Lighting toothbrush 20 includes an elongated body 22 having a longitudinal axis 24. A motion switch 26, having a motion-sensing axis 28 (refer to FIG. 2) is carried by body 22. Motion-sensing axis 28 is oriented substantially parallel to longitudinal axis 24, so that when lighting toothbrush 20 is moved back and forth along longitudinal axis 24, as would be done when brushing ones teeth horizontally, motion-sensing axis 28 is also moved back and forth. At least one light emitting device 30 is carried by body 22. In the shown embodiment there are three light emitting devices 30, however it may be readily appreciated that a larger or lesser plurality could also be disposed within body 22. Also in a preferred embodiment, light emitting devices 30 are light emitting diodes (LEDs), however other devices such as incandescent bulbs could also be used. The LEDs can be of different colors. A timer 32 is carried by body 22, with motion switch 26 and the at least one light emitting device 30 connected to timer 32. When body 22 is oscillated substantially along longitudinal axis 24, motion switch 26 closes actuating timer 32 which in turn applies a voltage waveform 50 (refer to FIG. 6) to the at least one light emitting device 30 for a predetermined period of time (for example 5 seconds). In a preferred embodiment, timer 32 is an integrated circuit (IC). It is noted that the oscillation does not have to be directly along longitudinal axis 24, but rather must only have a component of motion along motion-sensing axis 28 which is sufficient to close motion switch 26.

A power source 34, such as a battery or batteries, is also carried by body 22. Power source 34 is connected to timer 32 and provides power thereto. Also, in a preferred embodiment, motion switch 26, light emitting device(s) 30, timer 32, and power source 34 are all permanently encapsulated within the transparent body 22. In contrast to being externally disposed on body 22, the encapsulation ensures that the components are protected from possible water damage. By making body 22 transparent, a creative visual effect is provided wherein a user can see the various components, and in particular can observe the operation of the motion switch 26.

Figure 2:
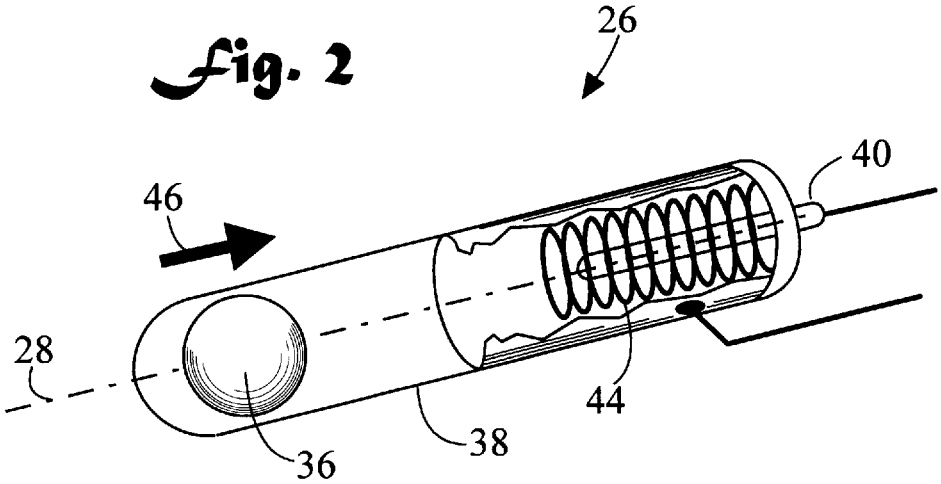
FIG. 2 is an enlarged perspective view of a motion switch in the open position.
Figure 3:
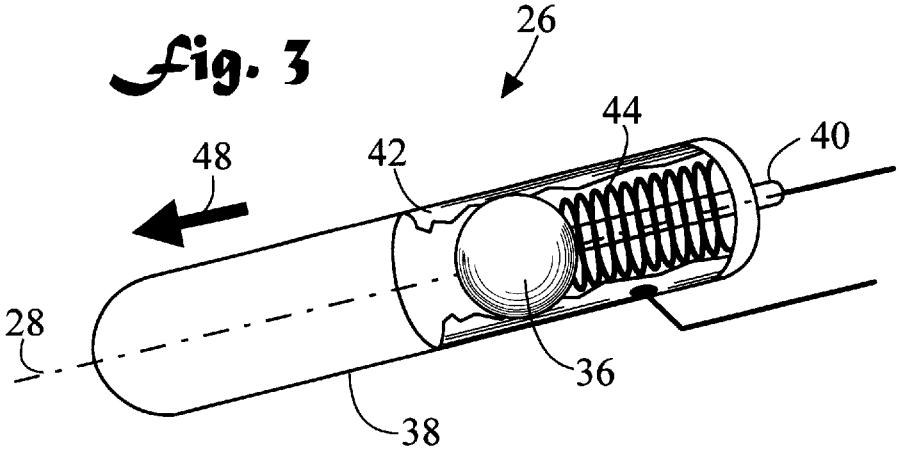
FIG. 3 is an enlarged perspective view of the motion switch in the closed position.

FIG. 2 is an enlarged perspective view of motion switch 26 in the open position, and FIG. 3 is an enlarged perspective view of motion switch 26 in the closed position. Motion switch 26 includes a movable conductor 36 having a weight such as a steel ball. Movable conductor 36 is free to move back and forth along motion-sensing axis 28 in a transparent tube 38. A rod comprises a first electrical pole 40, and a sleeve (shown in break away format) comprises a second electrical pole 42. A spring 44 is oriented along motion-sensing axis 28, surrounds first pole 40, and biases movable conductor 36 away from first pole 40. That is, spring 44 extends past the end of first pole 40 thereby preventing movable conductor 36 from contacting first pole 40. However, when body 22 of toothbrush 20 is oscillated substantially along said motion-sensing axis 28 in directions 46 and 48, the weight (inertia) of movable conductor 36 overcomes the biasing effect of spring 44, and movable conductor 36 compresses spring 44 and contacts both first pole 40 and second pole 42, thereby closing said motion switch 26. Spring 44 has a stiffness or "K" value. By selecting the desired stiffness, spring 44 of motion switch 26 establishes the degree of oscillatory motion required to close motion switch 26. For a stiff spring 44, rapid oscillations would be required, while for a more flexible spring 44, slower oscillations would be sufficient to close motion switch 26.

Figure 4:
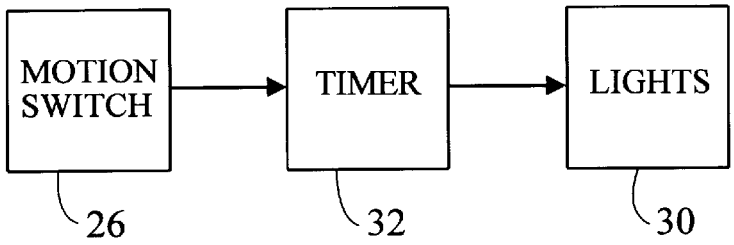
FIG. 4 is a block diagram of the electrical circuitry of the lighting toothbrush.

FIG. 4 is a block diagram of the electrical circuitry of lighting toothbrush 20. When motion switch 26 senses motion, it closes thereby sending a closure signal to timer 32, which in turn applies a voltage waveform to lights 30 (L1, L2, and L3) for a predetermined period of time.

Figure 5:
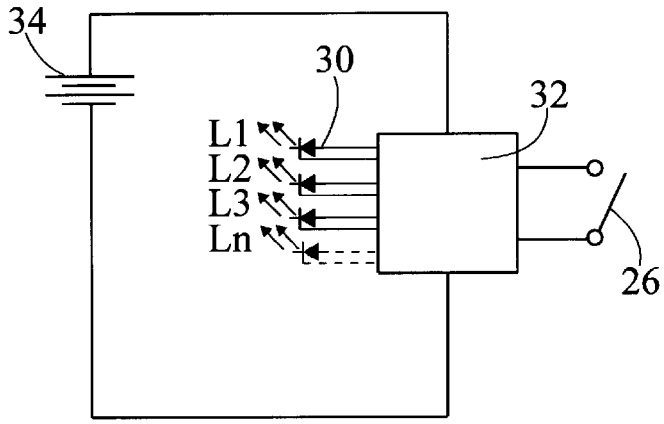
FIG. 5 is a schematic diagram of the electrical circuitry.

FIG. 5 is a schematic diagram of the electrical circuitry of a preferred embodiment, showing motion switch 26, lights 30, timer 32, and power source 34. It may be readily appreciated that many other circuit configurations are possible which accomplish the same end result, and these are intended to be embraced by the principles, concepts, and claims of the present invention.

Figure 6:
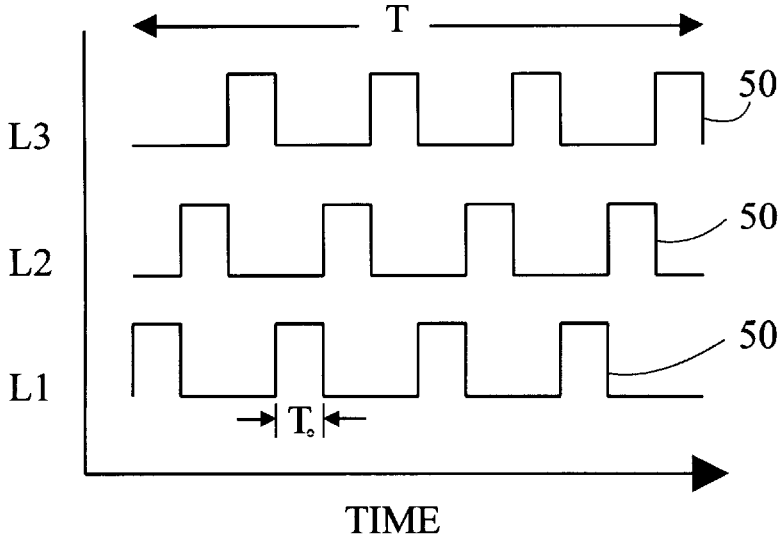
FIG. 6 is timing diagram of voltage waveforms.

FIG. 6 is a timing diagram of the voltage waveforms 50 produced by timer 32. Timer 32 applies a voltage waveform 50 to lights L1, L2, and L3 for a predetermined period of time T whenever motion switch 26 closes. The upward excursions of voltage waveform 50 represent the predetermined duration $T_o$ in which a light emitting device is illuminated. After the predetermined period of time T has elapsed, the voltage waveform 50 is discontinued and the lights are therefore all off. As soon as the oscillatory motion again closes motion switch 26, the waveform is again applied for a new predetermined period of time T. In a preferred embodiment period of time, T is 5 seconds, however it may be appreciated that any value may be selected. The smaller the value of T, the more consistent is the oscillatory motion required to keep the lights on. In the shown preferred embodiment, timer 32 applies the same voltage waveform 50 to each of the plurality of light emitting devices (L1, L2, and L3) in time-phased sequence. That is, L1 will illuminate first, then L2, then L3, then L1, then L2, etc. This "twinkling" cycle is repeated four times during predetermined period T. It may be appreciated that timer 32 could be designed to produce an infinite number of timing and illuminating combinations.

FIG. 7 is a perspective view of a second embodiment of a lighting toothbrush, generally designated as 120. Toothbrush 120 is identical to toothbrush 20, with the exception that motion sensing axis 128 is oriented perpendicular to both a longitudinal axis 124 and a bristle axis 156. In this fashion, it is not longitudinal motion which illuminates the lights, but rather up-and-down motion along the length of the teeth. Lighting toothbrush 120 includes an elongated body 122 having an end 152 and the longitudinal axis 124. Bristles 154 are disposed near end 152 and define the bristle axis 156 which is substantially perpendicular to longitudinal axis 124. A motion switch 126, having a motion-sensing axis 128 (refer also to FIG. 8) is carried by body 122. Motion-sensing axis 128 is oriented substantially perpendicular to both longitudinal axis 124 and bristle axis 156, so that when lighting toothbrush 120 is moved up and down substantially along motion-sensing axis 128, as would be done when brushing ones teeth vertically, motion-sensing axis is also moved up and down. At least one light emitting device 130 is carried by body 122. In the shown embodiment there are three light emitting devices 130, however it may be readily appreciated that a larger or lesser plurality could also be disposed within body 122. Also in a preferred embodiment, light emitting devices 130 are light emitting diodes (LEDs), however other devices such as incandescent bulbs could also be used. The LEDs can be of different colors. A timer 132 is carried by body 122, with motion switch 126 and the at least one light emitting device 130 connected to timer 132. When body 122 is oscillated substantially along motion sensing axis 128 in directions 155 and 157, motion switch 126 closes actuating timer 132 which in turn applies a voltage waveform identical to voltage waveform 50 shown in FIG. 6 to the at least one light emitting device 130 for a predetermined period of time (for example 5 seconds). In a preferred embodiment, timer 132 is an integrated circuit (IC). It is noted that the oscillation does not have to be directly along motion-sensing axis 128, but rather must only have a component of motion along motion-sensing axis 128 which is sufficient to close motion switch 126.

A power source 134 such as a battery or batteries is also carried by body 122. Power source 134 is connected to timer 132 and provides power thereto. Also, in a preferred embodiment, motion switch 126, light emitting device(s) 130, timer 132, and power source 134 are all permanently encapsulated within a transparent body 122.

FIG. 8 is a perspective view showing the relationship of the axes in lighting toothbrush 120. Motion-sensing axis 128 is substantially perpendicular to both longitudinal axis 124 and bristle axis 156.

Body 22 or 122 can be fabricated from a variety of materials, a clear polymer being preferred.

In terms of operation, while brushing the teeth, lighting toothbrushes 20 and 120 are simply oscillated in either a substantially horizontal or vertical direction respectively to cause the lights to illuminate.

The preferred embodiments of the invention described herein are exemplary and numerous modifications, dimensional variations, and rearrangements can be readily envisioned to achieve an equivalent result, all of which are intended to be embraced within the scope of the appended claims. For example, a lighted toothbrush could be produced having both longitudinal and up-and down motion switches.

I claim:

1. A lighting toothbrush, comprising:

an elongated body having a longitudinal axis;

a motion switch carried by said body, said motion switch having a motion-sensing axis, said motion-sensing axis substantially parallel to said longitudinal axis;

at least one light emitting device carried by said body;

a timer carried by said body, said motion switch and said at least one light emitting device connected to said timer; and, so that when said body is oscillated substantially along said longitudinal axis, said motion switch closes actuating said timer which in turn applies a voltage waveform to said at least one light emitting device for a predetermined period of time.

2. A lighting toothbrush according to claim 1, further including:

said motion switch, said at least one light emitting device, and said timer encapsulated within said body.

3. A lighting toothbrush according to claim 1, further including:

said body being transparent.

4. A lighting toothbrush according to claim 1, further including:

a power source carried by said body, said power source connected to said timer.

5. A lighting toothbrush according to claim 1, further including:

said predetermined period of time being about 5 seconds.

6. A lighting toothbrush according to claim 1, further including:

a plurality of light emitting devices carried by said body.

7. A lighting toothbrush according to claim 6, further including:

said timer applying said voltage waveform to each of said plurality of light emitting devices in time-phased sequence.

8. A lighting toothbrush according to claim 6, further including:

said voltage waveform causing each said light emitting device to be illuminated for a predetermined duration.

9. A lighting toothbrush according to claim 1, further including:

said motion switch having a degree of oscillatory motion required to close.

10. A lighting toothbrush according to claim 1, said motion switch further including:

a movable conductor having a weight;

a first pole;

a second pole;

a spring oriented along said motion-sensing axis, said spring biasing said movable conductor away from said first pole; and, so that when said body is oscillated substantially along said motion-sensing axis, said weight of said movable conductor overcomes said biasing of said spring, and said movable conductor contacts both said first pole and said second pole, thereby closing said motion switch.

11. A lighting toothbrush according to claim 10, further including:

said spring having a stiffness; and, said stiffness of said spring establishing said degree of oscillatory motion required to close said motion switch.

12. A lighting toothbrush according to claim 1, further including:

a power source connected to said timer;

a plurality of light emitting devices;

said motion switch, said plurality of light emitting devices, said timer, and said power source encapsulated within said body;

said body being transparent; and, said timer applying said voltage waveform to each of said plurality of light emitting devices in time-phased relationship.

13. A lighting toothbrush, comprising:

an elongated body having an end and a longitudinal axis;

bristles disposed near said end, said bristles defining a bristle axis, said bristle axis substantially perpendicular to said longitudinal axis;

a motion switch carried by said body, said motion switch having a motion-sensing axis, said motion-sensing axis substantially perpendicular to both said longitudinal axis and said bristle axis;

at least one light emitting device carried by said body;

a timer carried by said body, said motion switch and said at least one light emitting device connected to said timer; and, so that when said body is oscillated substantially along said motion-sensing axis, said motion switch closes actuating said timer which in turn applies a voltage waveform to said at least one light emitting device for a predetermined period of time.

14. A lighting toothbrush according to claim 13, further including:

said motion switch, said at least one light emitting device, and said timer encapsulated within said body.

15. A lighting toothbrush according to claim 13, further including:

said body being transparent.

16. A lighting toothbrush according to claim 13, further including:

a power source carried by said body, said power source connected to said timer.

17. A lighting toothbrush according to claim 13, further including:

a plurality of light emitting devices carried by said body.

18. A lighting toothbrush according to claim 17, further including:

said timer applying said voltage waveform to each of said plurality of light emitting devices in time-phased sequence.

19. A method for brushing teeth, comprising:

providing a toothbrush having an elongated body having a longitudinal axis, a motion switch carried by said body, said motion switch having a motion-sensing axis, said motion-sensing axis substantially parallel to said longitudinal axis, at least one light emitting device carried by said body, a timer carried by said body, said timer providing a voltage waveform, said motion switch and said at least one light emitting device connected to said timer; and, oscillating said body substantially along said longitudinal axis, so that said motion switch closes actuating said timer which in turn applies said voltage waveform to said at least one light emitting device for a predetermined period of time.

20. A method for brushing teeth, comprising:

providing a toothbrush having a transparent elongated body having an end and a longitudinal axis, bristles disposed near said end, said bristles oriented parallel to a bristle axis, said bristle axis substantially perpendicular to said longitudinal axis, a motion switch carried by said body, said motion switch having a motion-sensing axis, said motion-sensing axis substantially perpendicular to both said longitudinal axis and said bristle axis, at least one light emitting device carried by said body, a timer carried by said body, said timer providing a voltage waveform, said motion switch and said at least one light emitting device connected to said timer; and, oscillating said body substantially along said motion-sensing axis, so that said motion switch closes actuating said timer which in turn applies said voltage waveform to said at least one light emitting device for a predetermined period of time.

* * * * *